US007908767B1

(12) United States Patent
Mordecai et al.

(10) Patent No.: US 7,908,767 B1
(45) Date of Patent: Mar. 22, 2011

(54) PROTECTIVE FOOTWEAR FOR FIREFIGHTERS AND EMERGENCY RESPONDERS

(75) Inventors: Mark Mordecai, Hampton, NH (US); Anthoney Shawn Deaton, Apex, NC (US); Daniel Biron, Lee, NH (US)

(73) Assignee: Hi-Tec Sports USA, Modesto, CA (US)

( * ) Notice: Subject to any disclaimer, the term of this patent is extended or adjusted under 35 U.S.C. 154(b) by 863 days.

(21) Appl. No.: 11/615,242

(22) Filed: Dec. 22, 2006

Related U.S. Application Data

(60) Provisional application No. 60/753,966, filed on Dec. 23, 2005.

(51) Int. Cl.
*A43B 3/02* (2006.01)

(52) U.S. Cl. ..... 36/1.5; 36/113

(58) Field of Classification Search ..... 36/1.5, 36/113, 101, 70 R
See application file for complete search history.

(56) References Cited

U.S. PATENT DOCUMENTS

| | | | | | |
|---|---|---|---|---|---|
| 732,609 | A | * | 6/1903 | Wehn et al. | 36/1 |
| 993,203 | A | * | 5/1911 | Savage | 36/9 R |
| 2,848,825 | A | | 6/1957 | Dollar | |
| 4,064,641 | A | * | 12/1977 | Levine | 36/1.5 |
| 4,543,670 | A | * | 10/1985 | Ehring | 2/85 |
| 4,638,579 | A | * | 1/1987 | Gamm | 36/136 |
| 4,858,342 | A | * | 8/1989 | Nicholson et al. | 36/109 |
| 5,072,454 | A | | 12/1991 | Trahan | |
| 5,090,057 | A | * | 2/1992 | Aldridge | 2/82 |
| 5,546,680 | A | * | 8/1996 | Barma et al. | 36/108 |
| 5,970,633 | A | * | 10/1999 | Jones et al. | 36/136 |
| 6,651,257 | B2 | * | 11/2003 | Smith | 2/239 |
| 2006/0048291 | A1 | | 3/2006 | Sims | |

OTHER PUBLICATIONS

US Office Action dated Mar. 31, 2009 issued in U.S. Appl. No. 11/615,262, 10 pages.

* cited by examiner

*Primary Examiner* — Ted Kavanaugh
(74) *Attorney, Agent, or Firm* — Finch & Maloney PLLC

(57) ABSTRACT

Protective footwear for responders such as firefighters, civil defense, and defense workers is described. Different aspects include a boot with a flange for forming a vapor/liquid tight seal with trousers, methods of making the boot and methods of using the boot.

16 Claims, 16 Drawing Sheets

PROTECTIVE FOOTWEAR FOR FIREFIGHTERS AND EMERGENCY RESPONDERS

RELATED APPLICATION

This application claims benefit of U.S. Provisional Patent Application Ser. No. 60/753,966, filed Dec. 23, 2005, titled PROTECTIVE APPAREL FOR FIREFIGHTERS AND EMERGENCY RESPONDERS and which is incorporated by reference in its entirety herein.

BACKGROUND OF INVENTION

1. Field of Invention

The invention relates to apparel, and in particular, to trousers and boots that may be used to protect the wearer from exposure to liquids, aerosols and/or vapors.

2. Discussion of Related Art

The field of the emergency response has become broader and of greater importance in the past several years. Emergency responders, such as firefighters, EMTs, policemen, civil defense workers and defense workers now need to be prepared for hazards beyond fires, floods, and conventional warfare. Firefighters can be well protected against flame, heat and water by firefighter apparel that includes waterproof and thermal layers, such as those described in U.S. Pat. No. 5,884,332 to Snedeker, which is incorporated by reference herein. Responders may now need to respond to incidents where it is important to be protected not only against flame, heat and water, but against toxic chemicals, chemical warfare agents and biological pathogens. These hazardous substances may be present in the form of solids, liquids, aerosols, vapors or gases and therefore may bypass the protection provided by conventional firefighter apparel that is typically designed to protect against flame, heat, and water.

Exposure to hazardous substances, such as chemical, biological or radiological agents, even minimal exposure, can be fatal or cause permanent injury. Apparel and equipment currently exist that are capable or partially capable of protecting a responder against these hazards, but in many cases, the apparel, which may be an impermeable full body suit may be uncomfortable and difficult or impossible to work in under some conditions. Furthermore, these protective suits may be of limited utility in responding to conventional fires or medical emergencies as their durability may be limited. Such garments are described, for example, in U.S. Pat. No. 5,948,708 to Langley.

These hazardous materials suits may limit mobility and may hamper a responder's ability to operate under emergency conditions. They typically do not provide protection from flame and/or heat. In addition, the lack of comfort that is typically experienced in using these types of protective suits means that responders are unlikely to don this protection until they are specifically called to respond to an unconventional event. Consequently, the emergency responder's ability to quickly rescue ambulatory victims or to escape from such an event with appropriate protection is compromised. Apparel that would provide comprehensive protection against chemical and biological hazards and would be more comfortable and user-friendly than hazmat suits would give the responder greater protection and confidence in performing his or her duties and would find widespread acceptance among responders of all types and, in particular, among firefighters.

SUMMARY OF INVENTION

The subject matter of this application may involve, in some cases, interrelated products, alternative solutions to a particular problem, and/or a plurality of different uses of a single system or article.

In one aspect, a protective boot for use with resistant barrier trousers is provided, the boot comprising an upper having an interior and an exterior, a sole affixed to the upper, and a flange around a portion of the exterior of the upper, the flange including a shoulder constructed and arranged to retain a resistant barrier liner cuff of the resistant barrier trousers.

In another aspect, a method of manufacturing a protective boot is provided, the method comprising attaching an upper to a sole, surrounding a portion of the upper with a flange, and securing the flange to the upper to produce a boot capable of interfacing with a cuff of a resistant barrier liner in a pair of trousers.

BRIEF DESCRIPTION OF DRAWINGS

In the drawings, FIG. 1*a* provides a perspective view of a boot and flange of the invention.

DETAILED DESCRIPTION

Figure 1A:
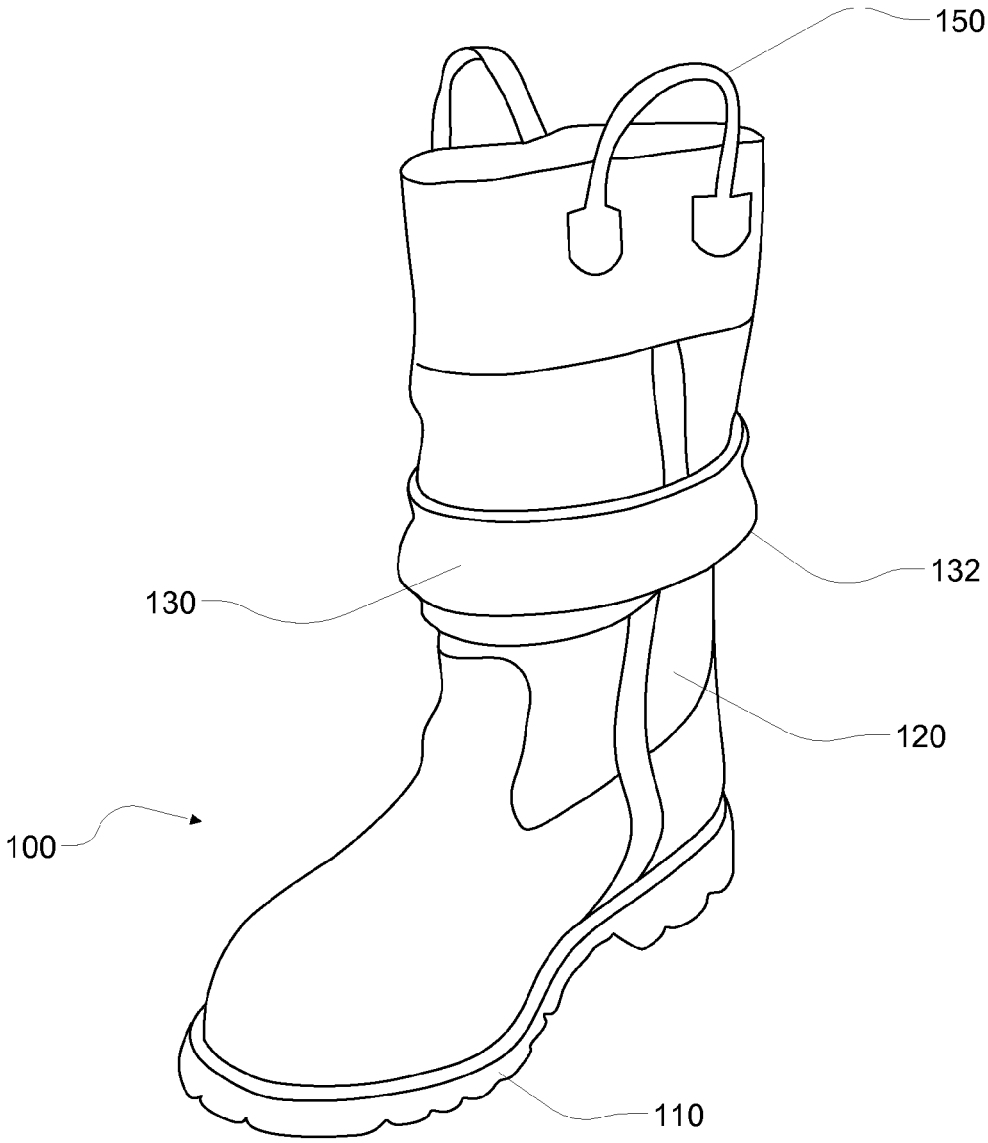
FIG. 1*b* provides a perspective view of another embodiment of a boot and flange of the invention.

In one aspect, the invention relates to boots including a flange for forming a vapor/liquid resistant seal when used in conjunction with vapor/liquid resistant trousers.

In another aspect, the invention relates to vapor/liquid resistant trousers for protecting the wearer against chemical and/or biological contamination.

In another aspect, the invention relates to a boot and trouser combination designed to protect the wearer against chemical and/or biological contamination.

In another aspect, the invention relates to trousers that may include a liner wherein the liner includes a gusset for protecting the torso of the wearer from contamination with chemical and/or biological hazards.

"Selectively Permeable" describes a material that allows the passage of some substances while preventing the passage of others.

"Vapor/liquid Resistant" means that a material with this property can prevent entry of undesirable vapors and/or liquids as well as aerosols. It may be permeable to some substances such as water vapor.

"Resistant barrier layer" means a layer that prevents the passage of a hazardous substance such as a chemical agent or a biological pathogen.

"Water Vapor Permeable" describes a material that is substantially impervious to liquid water but can allow the passage of water vapor at a rate of at least 100 $g/m^2/day$.

The invention is directed, in part, to a system of apparel that provides a protective interface between trousers and boots worn by a responder. Whereas previously designed interfaces between pant cuff and boot may have been ineffective at preventing materials such as chemical agents and biological pathogens from contacting the wearer, the apparel system described herein may be used to effectively reduce or prevent the breach of dangerous substances through this interface. In one aspect, an apparel system includes trousers comprising, in part, a resistant barrier layer that may be effective at repelling dangerous vapors, aerosols and liquids. In some embodiments, the barrier layer is permeable to water vapor, allowing the garment to breathe while protecting the responder from dangerous vapors and/or liquids. The barrier layer may include a cuff in the ankle area that is designed to form a vapor/liquid resistant interface with a boot as described below.

In another aspect, a boot is provided that allows the boot to be joined to the trousers in a manner that can prevent the entry of vapors, aerosols and/or liquids. The boot may include a flange that surrounds the upper of the boot, and this flange may be used to interface with the cuff of a pair of trousers, thus allowing the trousers and boots to be donned independently while providing a continuous safety barrier from waist to toe. The flange may aid in preventing the trouser cuff from pulling off of the boot. The flange may include a shoulder, groove or cavity that provides a secure surface for retaining the cuff of the trousers even during the strenuous activities that a responder may experience during a response event. The boots may be used with or without the trousers and the barrier layer cuff may be engaged or disengaged with the boot by the responder. In addition to protecting against chemical and biological hazards, the boots may be worn by a responder, such as a firefighter, prior to or after an event or during a conventional emergency where protection against chemical agents and biological pathogens may not be necessary.

Similarly, the trousers may be used under a variety of conditions as they may include a resistant barrier liner that can either be removable or may be permanently attached. In addition, the trousers may optionally be worn with boots not specifically designed for interfacing with the trousers. The boot may include a resistant barrier layer made of similar material to that used in the trousers, or may be made of a different material or combination of materials. For example, the boot may include a non-permeable barrier that need not be breathable while the trousers may include a breathable barrier layer. This breathable layer can provide for the expulsion of moisture from a significant portion of the responder's skin surface, providing a greater degree of comfort. In a preferred embodiment, both the boots and the trousers include a water vapor permeable layer providing comfort to the wearer for extended periods of time.

A resistant barrier layer can function by preventing or retarding hazardous substances such as toxic chemicals, chemical warfare agents and biological pathogens from reaching the skin of the responder. The barrier layer may typically be one of two different types. A first type of barrier layer functions by repelling substances such as liquids and vapors. For example, the barrier layer may prevent the passage of a particular compound by exhibiting pore sizes that exclude a compound from passing through. A second type of barrier layer functions by adsorbing a substance rather than excluding it. For example, the barrier layer may include an adsorbent, such as activated carbon, that prevents the passage of undesirable substances by causing the substances to adhere to the adsorbent. In this manner, the substance may not be repelled by the barrier but is prevented from reaching the skin of the responder.

The resistant barrier liner may be made of any material that prevents or inhibits liquids and/or vapors from penetrating the liner. The barrier liner may be formed from woven and/or non-woven materials such as membrane films and in some embodiments is permeable to water vapor. The barrier layer may include one or more layers, for example, the barrier layer may be a laminate comprising a backing material or support layer laminated to a layer of semi-permeable membrane material and may also include an abrasion resistant material. The different layers may be affixed together by an adhesive. Some examples of polymers that may be useful as adhesives include polyurethane, natural latex rubber, nitrile rubber, silicone rubber, butyl rubber, fluorinated rubber, copolyether polyester, polyester, ethylene vinyl acetate or polyamide.

The resistant barrier layer or liner may include selectively permeable materials such as semi-permeable or "breathable" membranes that are water vapor permeable. Selectively permeable materials can include, for example, polyurethane, polytetrafluoroethylene (PTFE), polyester, polyether, polyamide, polyacrylate, copolyether ester and copolyether amides. Some preferred breathable membranes include expanded PTFE such as described in U.S. Pat. No. 4,187,390, incorporated by reference herein. Other materials that may be used in one or more layers of a resistant barrier liner include aramids such as NOMEX™ and para-aramids such as poly para-phenyleneterephthalamide. Additional materials that can be used in resistant barrier layers are described in U.S. Pat. No. 7,022,632, titled COMPOSITE NONWOVEN FABRIC FOR PROTECTIVE CLOTHING AND PRODUCTION METHOD THEREOF, and in U.S. patent application Ser. No. 10/513,738, titled BREATHABLE ARTICLES, published as 2005/0176331; both of these applications are incorporated by reference herein.

When worn together, the trousers and boots of the invention can provide an ensemble that may protect the wearer from waist to toe from exposure to harmful chemicals and biological pathogens that are typically in the form of (or carried in) vapors or liquids. The trousers may be combined with additional garments, for example, a coat, hood, breathing apparatus and/or gloves to provide full body protection. The trousers and/or boots may include one or more layers in addition to a barrier liner. For example, the trousers and/or boots may include an abrasion-resistant layer, a thermal layer and/or a flame resistant layer. Choice of layers may be determined in part by the type of emergency or situation that the responder is most likely to be called to. The amount of time the responder is expected to wear the garment may also help to determine the composition of the trousers and/or boots. Firefighters' apparel, for example, may include flame resistant and thermal layers. A soldier's apparel, however, might not include a thermal layer but may include a camouflage abrasion resistant layer.

Materials may be chosen so that the ensemble or apparel complies with one or more of NFPA Standards 1951, 1971, 1992, 1999, and 1994. Specifically, in some embodiments, the combination trousers and boots may form part of an ensemble that pass the "Man In Simulant Test" to meet the CBRN option of NFPA 1971. Some compounds and biological pathogens that may be specifically protected against include, for example, nerve agents, mustard gas, phosgene, sarin, pathogenic bacteria such as anthrax, and viruses. The apparel may also prevent the transmission of radioactive particulates or aerosols.

In some embodiments the boots may be used with or without trousers that include a barrier layer. A boot that can optionally be used with other types of trousers may be preferred by some users because this feature can allow the user to retain a single pair of boots that can be used under a variety of conditions. For instance, a firefighter may use the boots in combination with conventional firefighter's garments such as trousers that include an abrasion-resistant layer, a water proof layer, and a thermal layer, but that may not include a resistant barrier liner with an interlocking ankle cuff. However, preferably without modification, the same boots may be also be worn with the resistant barrier layer trousers described herein.

Figure 1B:
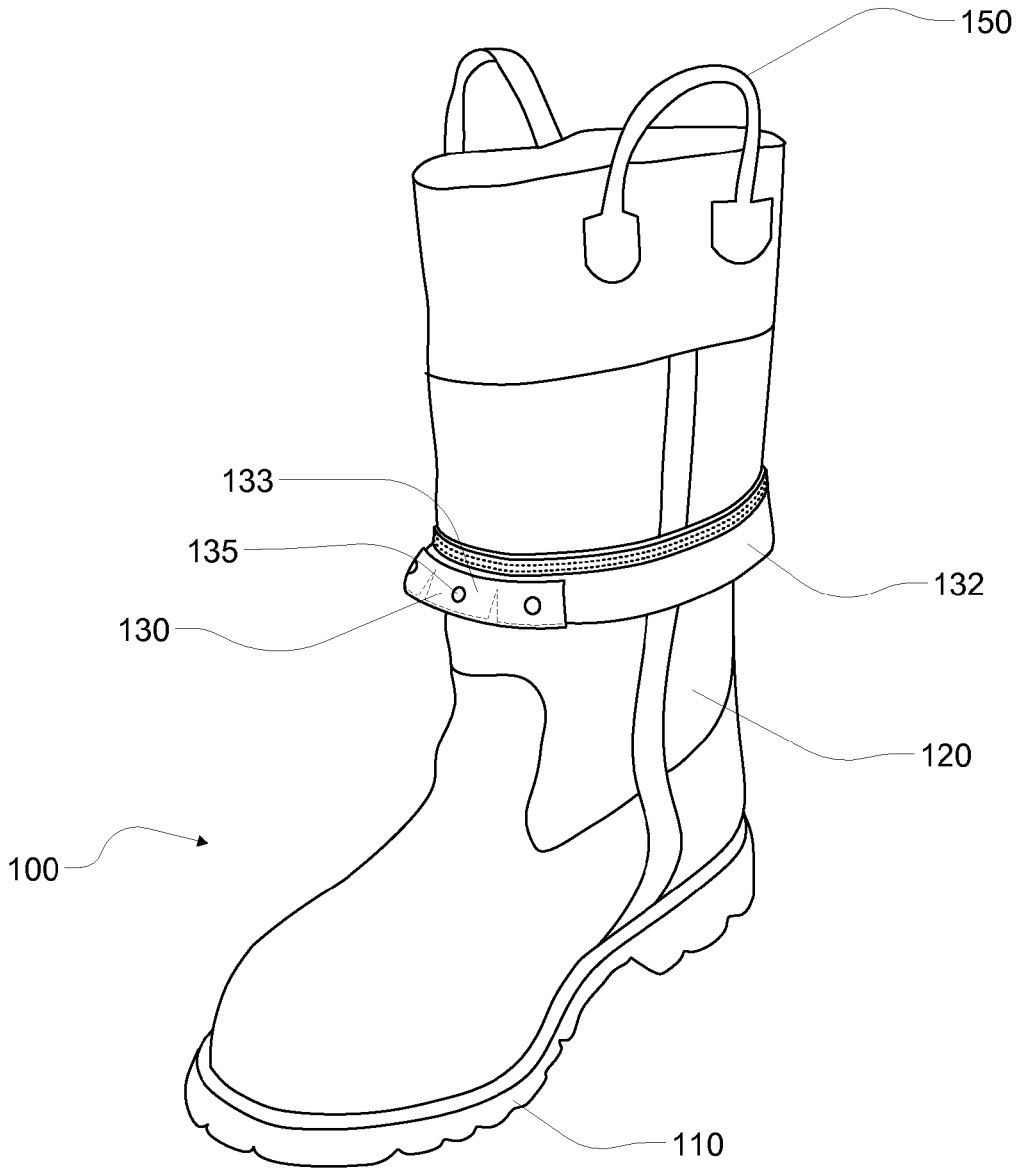

One aspect of the invention is depicted in FIGS. 1*a* and 1*b*. The figures illustrate boot 100 including sole 110 and upper 120. Flange 130 is generally in the shape of a ring and together with boot 100 is shown in cross-section in FIG. 2. Optional pull-up straps 150 are similar to conventional straps used on firefighters' boots and may aid in pulling on the boot. As flange 130 may stiffen a portion of upper 120, straps 150 may be particularly useful in helping to place the foot into the boot. Preferably, flange 130 surrounds the upper and is of a substantially circular shape, but may also be out-of-round, skewed or oblong in order to more closely match the natural shape of the upper. An oblong shape may also provide for easier foot entry into the boot. The inner circumference of flange 130 may be about the same as the exterior circumference of the boot upper 120. The outer circumference of the flange may be, for example, more than 5%, more than 10% or more than 20% greater than the circumference of the boot upper at the position where the flange is attached to the boot upper. Flange 130 may include a shoulder 132 which provides a shelf or notch on which the cuff of the trousers may obtain purchase to prevent slippage. Shoulder 132 may be integral to flange 130 or may be formed from a separate piece that is either permanently or temporarily attached to flange 130. Flange 130 and/or shoulder 132 may be composed of any material capable of maintaining a trouser cuff in a sealed position. For example, the flange and/or shoulder may be made of a natural or synthetic polymeric material such as rubber, polyurethane, polyvinyl chloride (PVC) or PTFE. Other materials that are typically used to make boots, e.g., leather, may also be used to produce flange 130 and/or shoulder 132. It may be preferred that the flange material is flame resistant, such as flame resistant PVC.

As shown in FIG. 1*b*, portions of flange 132 may be cut in order to help the flange to conform to portions of the upper 120 that exhibit different amounts of curvature. These slices may be covered by a connector 133 that may be attached to the flange by, for example, an adhesive or rivets 135. Connector 133 may be, for example, plastic or leather.

Figure 2:
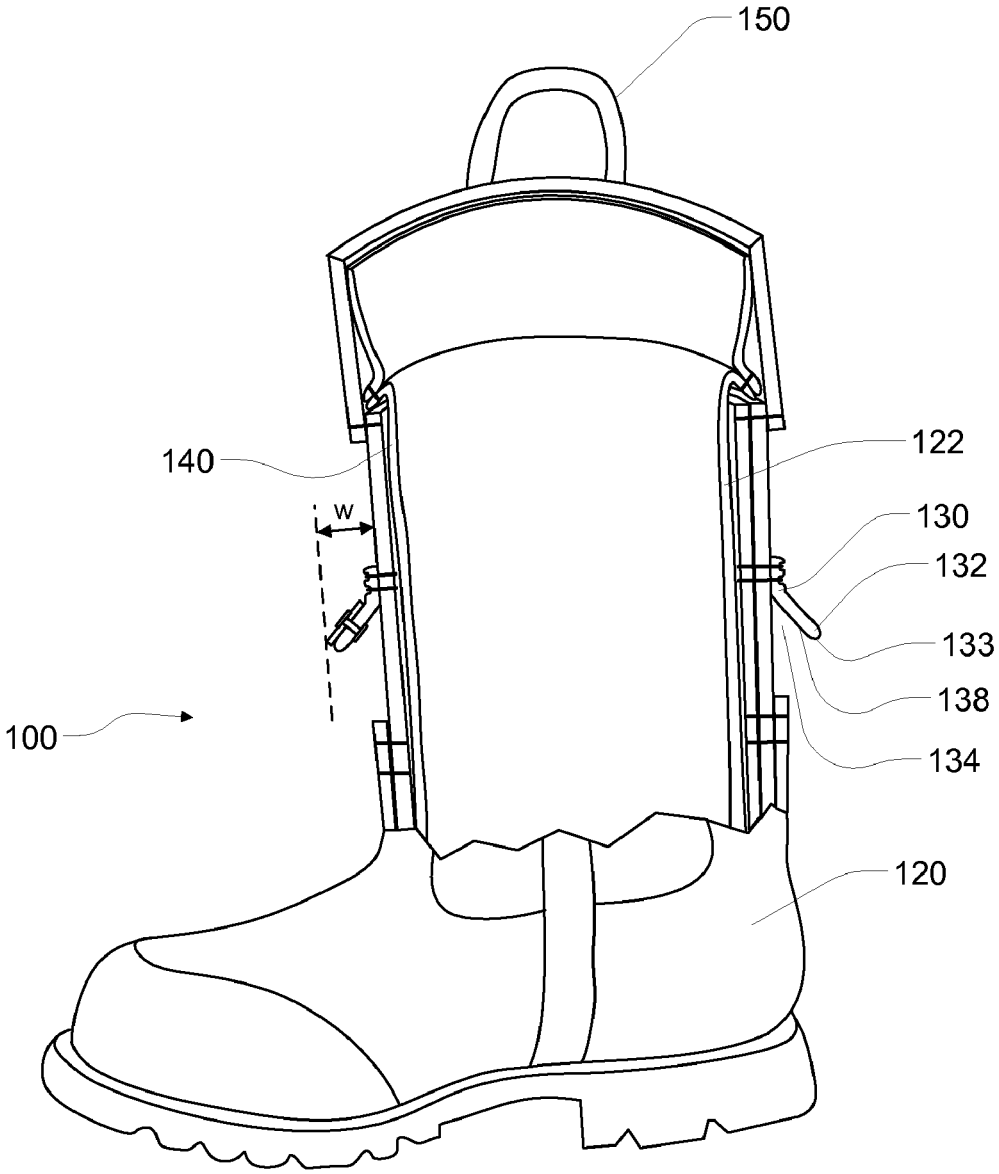
FIG. 2 provides a cross-sectional view of an embodiment of a boot and flange.

Flange 130 may be produced in a number of ways. For example, flange 130 may be formed, or molded, in a single, substantially ring-shaped piece or may be linearly extruded and cut into lengths equal to the circumference of the final flange. For some embodiments, the flange may be subjected to machining. In the case of extrusion, the ends may be subsequently connected end-to-end to form a substantially circular flange. Ends may be joined by connectors made out of, for example, leather, plastic, or rubber. The connectors may be joined to flange 130 using, for example, an adhesive or rivets. In other embodiments, adhesives or mechanical connectors, such as shrink-tubing for example, may be used to directly join the ends of the flange. Alternatively, some materials, such as thermoplastics, may be joined end-to-end by softening or melting the ends and adhering them together. The flange may vary in width and can be size-optimized to securely retain the trouser cuff when engaged while also minimizing interference with activity when used with other trousers or when not engaged with the cuff. In cases where flange 130 is formed integrally as part of the upper there need not be a step of attaching the flange to the upper. If flange 130 is a separate component as shown in FIGS. 1*a*, 1*b* and 2, then the flange is typically joined to upper 120 in a manner that prevents vapors and liquids from passing through the interface between flange 130 and upper 120. For instance, an adhesive may be applied around the inner surface of the flange that subsequently forms a vapor-tight seal with upper 120.

Other methods of attachment include, for example, stitching and ultrasonic welding. In some cases it may be advantageous to include a gasket between the flange and the upper in order to prevent leakage into the boot and/or into the trouser area. In some embodiments, a linear flange may be joined end-to-end concurrently with attachment of the flange to the upper. In other cases, the attachment to upper 120 may force the ends of the linear flange together when wrapped around upper 120, resulting in a circular flange. Although the ends may not be adhered together, they may be in contact and under compression to prevent any significant leakage between the surfaces. Under these conditions there may not be a need to adhere the ends together.

In FIGS. 1*a* and 1*b*, the flange is affixed to the outer surface of the upper. In other embodiments, the material that comprises the outer layer of the upper 120, e.g., a leather layer, can ride over the top rim and the bottom rim of the flange so that less of the flange is visible. This design may make flange 130 look less obtrusive and can provide an appearance in which flange 130 appears to be an integral part of the boot rather than an addition to an existing boot. In some cases, it may be that shoulder portion 132 is the only significant portion of the flange that is visible from the exterior. The upper may be attached to the flange as in other embodiments, for example, with an adhesive, by stitching, or by fusing. In cases where the flange is integral to the boot upper (the upper and flange are formed from a single continuous piece) the appearance of the boot may be that of a conventional boot with a flange circumventing the upper.

In FIG. 2, the width of flange 130 (shortest distance from a point on the inner circumference to a point on the outer circumference) is indicated by "W" and may vary depending, in part, on the design of the shoulder and the interlocking cuff on the trousers. In different embodiments the width may be greater than 0.5 cm, greater than 1.0 cm, or greater than 1.5 cm. While the width of flange 130 may vary around its circumference, in most embodiments the flange width is substantially constant throughout the entire ring. The flange may have a substantially consistent cross-sectional shape throughout the length of the entire ring.

Figure 3:
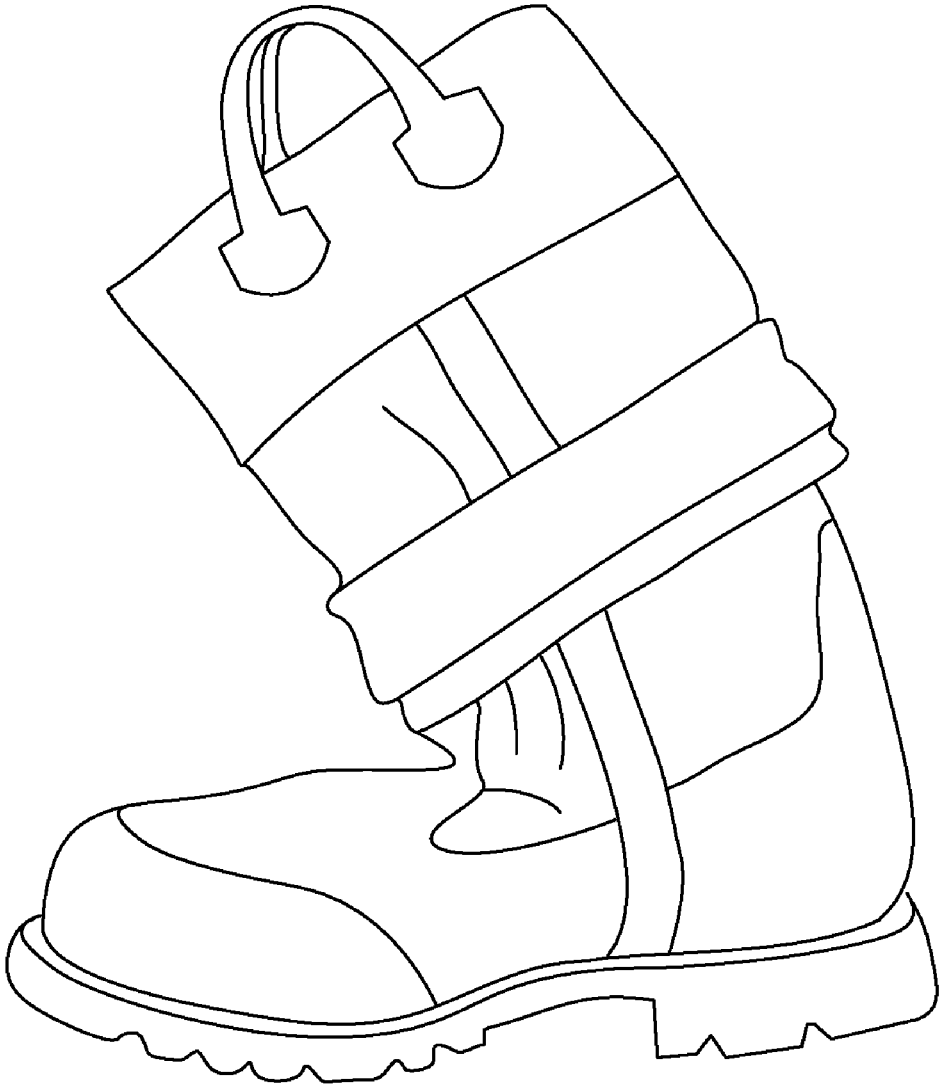
FIG. 3 provides a perspective view of an embodiment of a boot of the invention.

It has been found that dangerous leakage through conventional boot-trouser interfaces is most prevalent when the responder (wearer) bends the boot upper during vigorous activity, such as when walking, running or climbing. For instance, see the position of the boot shown in FIGS. 3 and 8. When the upper of a boot is bent in this manner, temporary crevices may form in the upper in a substantially vertical direction. Even if a trouser cuff is pulled tightly around a conventional boot upper, these crevices provide pathways for liquids and/or vapors to penetrate the trouser/boot interface and to potentially contact the responder's skin.

The use of a flange of substantial rigidity (in comparison to the upper material) in contact with the exterior of the upper may result in the elimination of these crevices with only a minimal decrease in the flexibility of the upper. Therefore, a trouser cuff can form a vapor/liquid tight seal that is not subject to crevice formation during movement. Any crevices that do form in the upper may be terminated at the flange due to, for example, the flange's thickness and/or higher rigidity. When a trouser barrier cuff is mated to the flange, the cuff may be in consistent surface contact around the entire flange because crevice formation is prevented even during vigorous activity. This can provide for the consistent maintenance of a vapor/liquid tight seal between the cuff and the flange which can help protect the responder from intrusion of vapors/liquids through the boot/cuff interface, particularly while running, climbing, crawling, etc.

Figure 5:
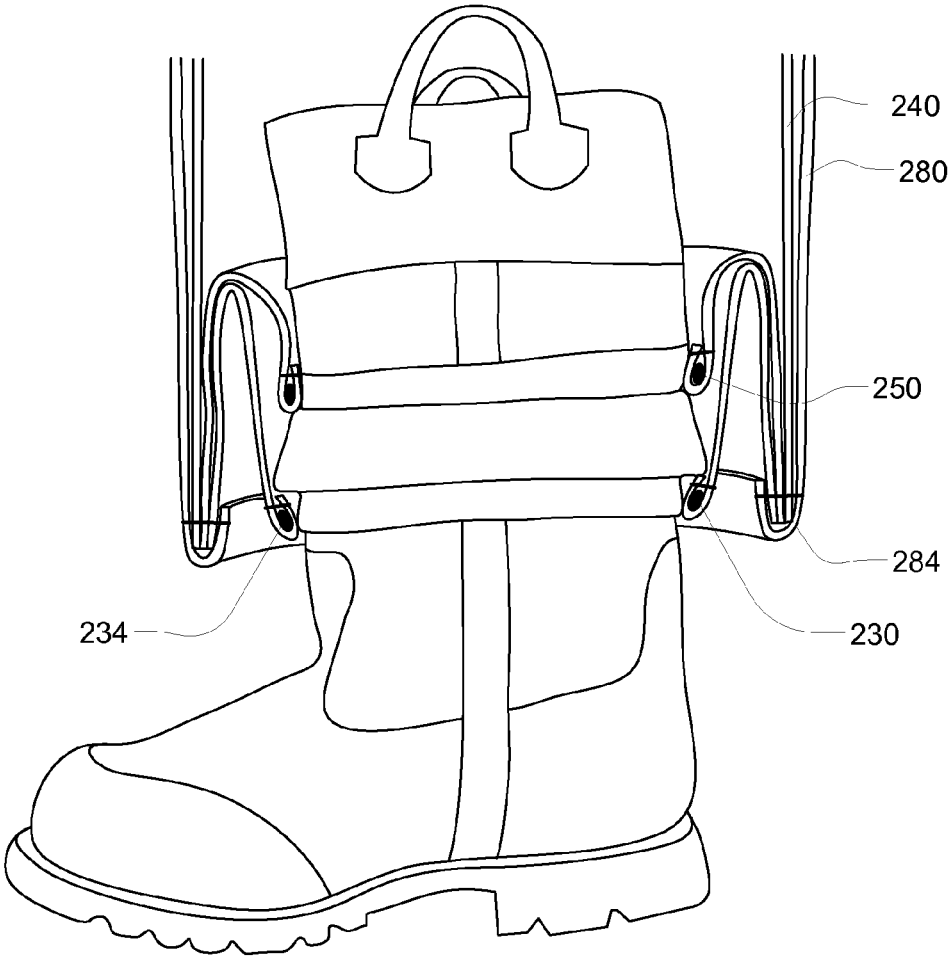
FIG. 5 provides a perspective view of an embodiment of a boot and flange with a cut-away view of trousers including two resistant barrier cuffs.
Figure 14:
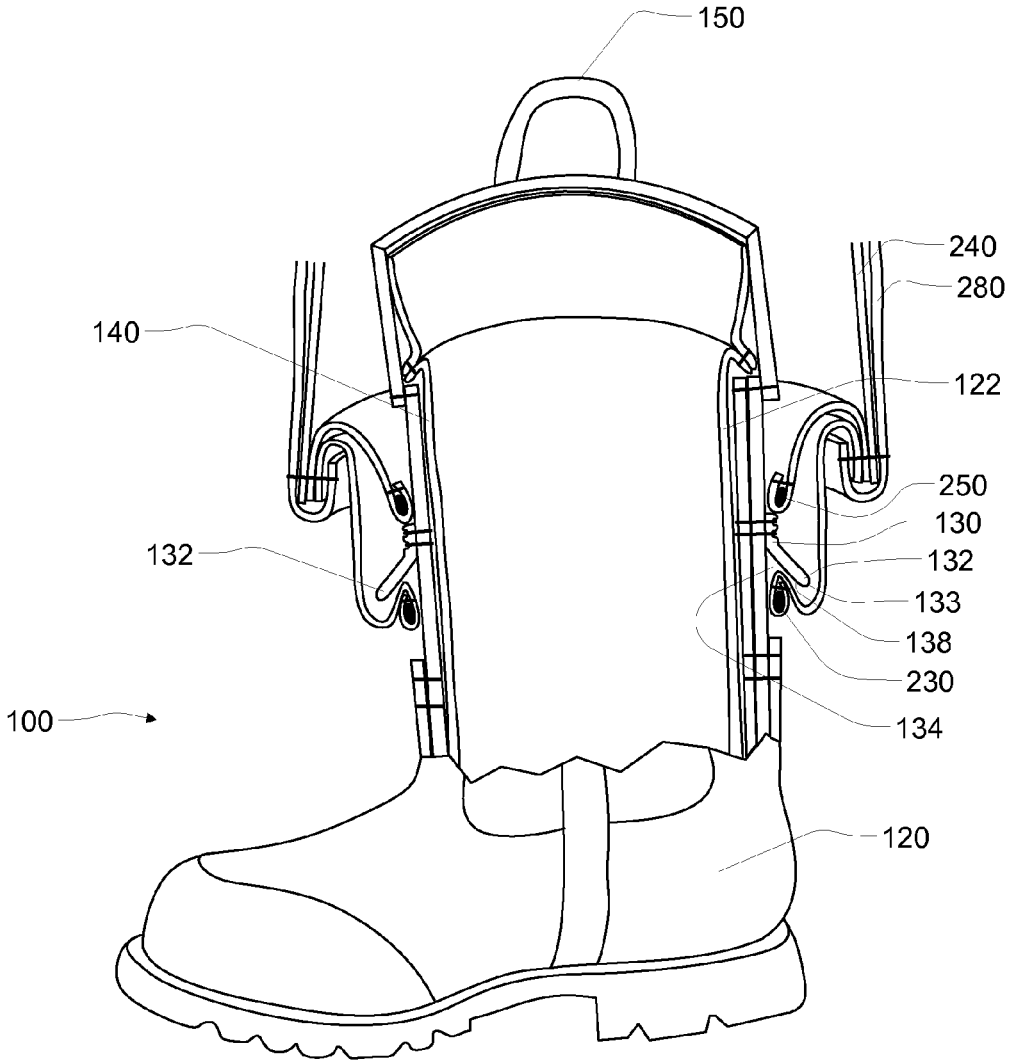
FIG. 14 provides a cross-sectional view of one embodiment showing boot, flange and trousers.
Figure 15:
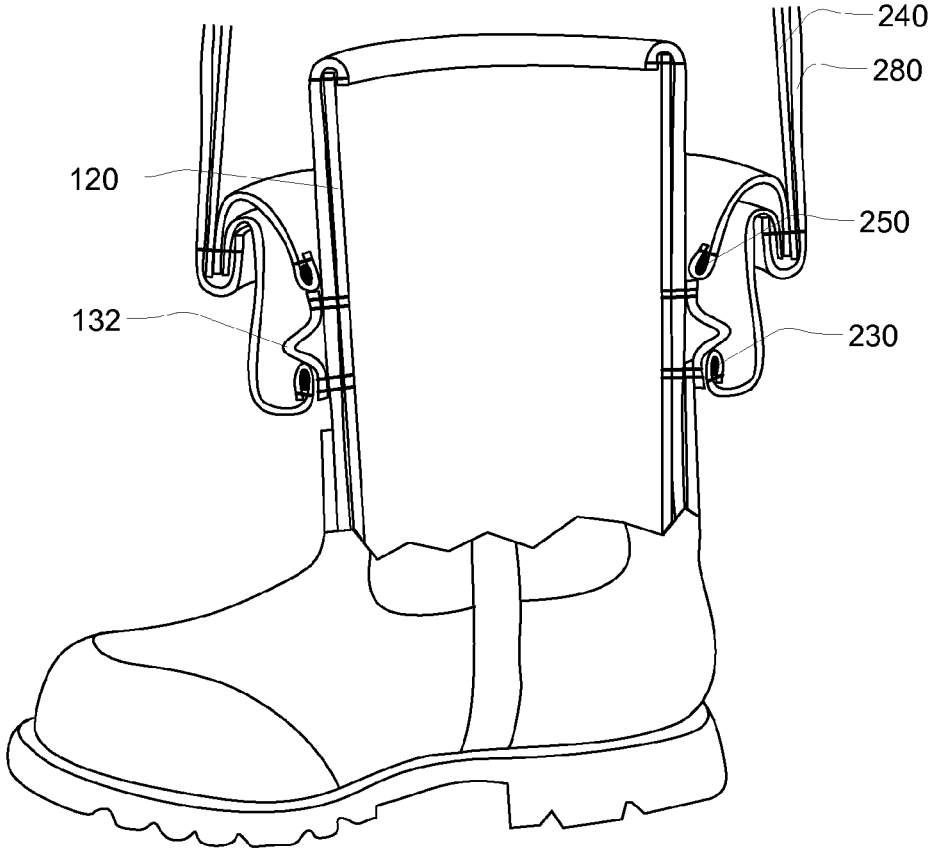
FIG. 15 provides a cross-sectional view of another embodiment showing boot, flange and trousers.

In some embodiments, e.g., FIG. 2, shoulder 132 may form a concave cavity 134 that may help to provide a more secure interface for a trouser cuff. In many of these embodiments, shoulder 132 forms a cavity around the entire flange ring. In most embodiments, the cavity will include a downward facing opening. A trouser cuff may be retained by the flange as illustrated in FIG. 5, or the trouser cuff can be folded under the flange. When a trouser cuff, such as a resistant barrier layer cuff, is folded or tucked into cavity 134 an additional resistant force may help to retain the cuff in the flange. When the cuff is turned up into cavity 134 (FIG. 14), shoulder lip 133 may provide frictional resistance that may prevent the removal of the cuff when an upward force (such as is applied when climbing or walking) is applied to trouser leg 200. Despite this additional holding power, the cuff may be easily removed by the wearer when desired. For instance, in some embodiments cuff 230 can be removed from cavity 134 by pulling downwardly on a portion of trouser barrier liner 240. This motion may serve to untuck cuff 230 from cavity 134 allowing the liner to then be pulled upwardly over the top of the boot, facilitating subsequent removal of the boot. Cavity 134 may vary in width and depth and in different embodiments may have a depth (vertical dimension in FIG. 2) to width (horizontal dimension of the cavity at tip 133 in FIG. 2) aspect ratio of, for example, greater than or equal to 1:2, 1:1, 2:1 or 3:1. Inner flange wall surface 138 may be angled downwardly to aid, for example, in retaining consistent contact with a trouser cuff. The angle of inner flange wall surface 138 to the surface of boot upper 120 may be, for example, less than or equal to 110°, less than or equal to 90°, less than or equal to 70°, less than or equal to 50° or less than or equal to 30°. As shown in FIG. 2 this angle is about 45°. As this inner flange angle decreases, the depth to width aspect ratio typically increases providing for a sharper, narrower cavity in which to tuck a trouser cuff. In addition to providing more resistance to accidental removal, the tucking of a trouser cuff into cavity 134 also may result in a more circuitous pathway for any hazardous substance to pass through in order for the hazardous substance to breach the trouser/boot interface. Thus, this embodiment may provide a greater level of protection from hazardous substance intrusion.

Figure 8:
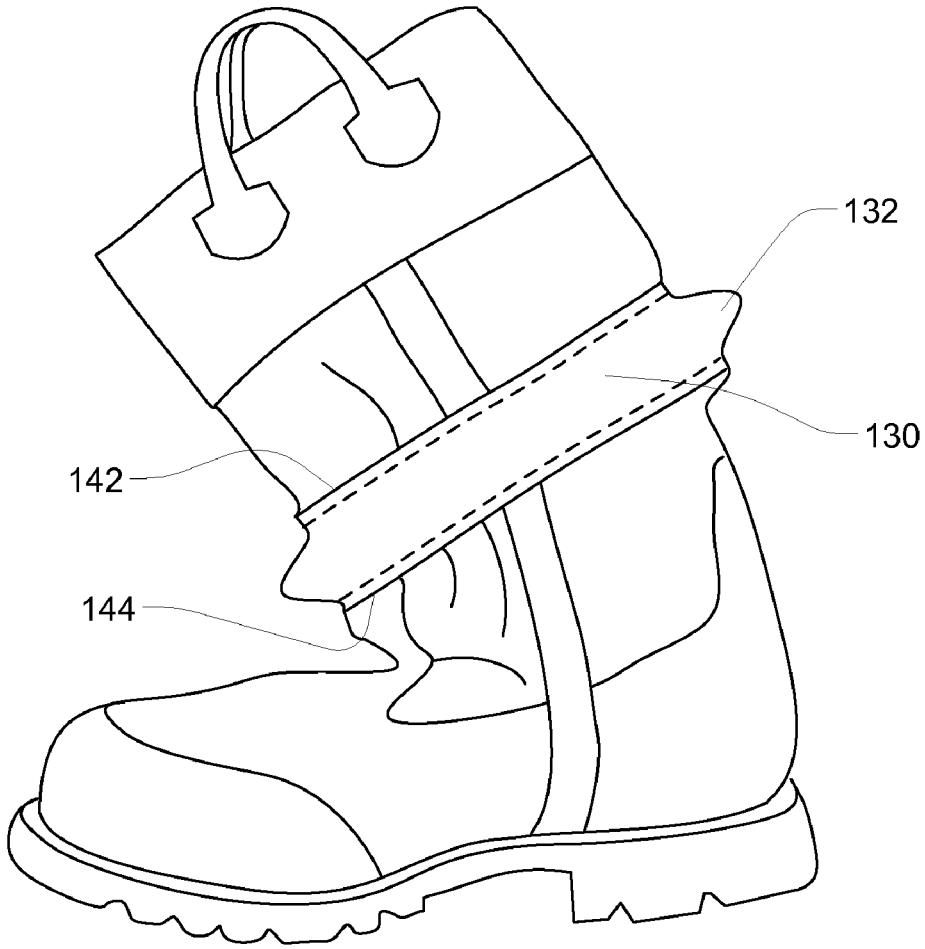
FIG. 8 provides another view of the embodiment shown in FIG. 6.

FIGS. 6-10*b* illustrate an embodiment wherein the flange may be formed of leather and provides an integral shoulder 132 to retain the cuff. This embodiment does not include a cavity as does the embodiment of FIG. 2. However, shoulder 132 may still serve to retain a trouser cuff that has been secured below the flange. As shown in cross section in FIG. 7, a strip of leather (or other material) can be sewn or otherwise affixed around the upper of the boot. Stitching and/or an adhesive, for example, may be used to attach the flange to the boot. The boot may include a resistant barrier liner 122 and sewing seams 136 may be taped if the stitching penetrates the liner. In other embodiments, the flange is stitched only to the upper and does not penetrate barrier liner 122. Before attaching the flange to the upper, the strip may be compressed from edge to edge to form a protrusion that becomes shoulder 132. Preferably, the shoulder extends to a degree whereby a trouser cuff can be securely retained by the flange. As shown in FIG. 8 a properly constructed flange may interrupt vertical creasing along the length of the upper even when the boot is bent at the ankle.

As the flange exhibits a greater circumference in a central portion (shoulder 132) than along edges 142 and 144, if the flange is formed from a substantially flat strip, sections such as triangular portions 146 and 148 may be removed from the strip to help form a proper shape when wrapped around the upper and secured. The resulting seams may be sealed, for example, with an adhesive. An additional treatment such as a wax or temporary adhesive may be used on the flange in order to increase the friction between the flange and a trouser cuff (as described herein).

In another aspect, vapor/liquid resistant barrier trousers are provided. The trousers may include an abrasion resistant outer layer 280 and a resistant barrier liner or layer 240 that can substantially prevent the intrusion of hazardous substances such as toxic chemicals and biological pathogens. Such trousers may be referred to as C/B or CBRN trousers. Substantially preventing the intrusion of a substance means that the substance is excluded at an efficiency whereby the garment satisfies the standard defined by NFPA 1971. Typically, this also means that the trousers (in combination with other apparel when appropriate) are in compliance with one or more of NFPA Standards 1951, 1971, 1992, 1999, and 1994, which are incorporated by reference herein.

A resistant barrier liner may be integral to other trouser layers or it may be an independent layer. If an independent layer, the liner may be removable from the trousers. Trousers with a removable liner may be used with or without the liner and this feature may also facilitate servicing of the trousers, the liner, or both. A removable barrier liner may be temporarily attached to the trousers by fasteners such as, for example, buttons, snaps, zippers or hook and loop.

Figure 4:
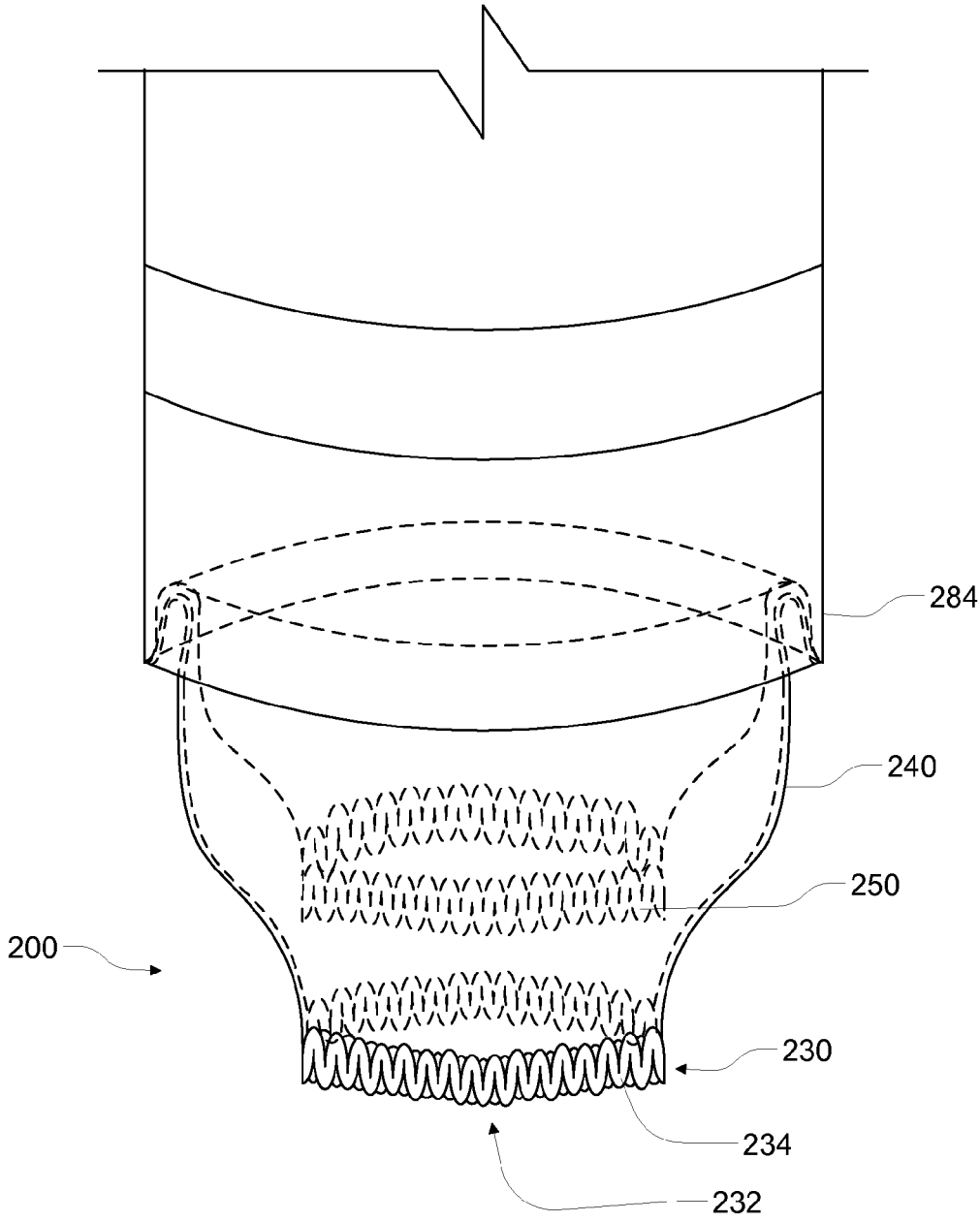
FIG. 4 provides a schematic view of an embodiment of a trouser leg and associated resistant barrier cuff.

Preferably, the trousers form a releasable seal with a boot providing for separate pieces of apparel (boot and trousers) to be temporarily joined to form a vapor/liquid barrier to protect the responder. The trousers may include cuff 230 and optional second cuff 250. Second cuff 250 may be comprised of the same materials as cuff 230. Cuff 230 is constructed and arranged to interface with a flange of a boot such as flange 130 as illustrated in FIGS. 1*a*, 1*b* and 2, for example. FIG. 4 provides a schematic view of a lower portion of the trousers showing lower cuff 230 and optional upper cuff 250. Cuff 230 forms a roughly truncated conical shape of barrier material and hides optional cuff 250, shown here in dashed lines.

Although the diameter of cuff 230 decreases in a direction toward cuff opening 232, it is preferred that the barrier material not decrease to a diameter equal to that of the flange, but rather that the circumference of the barrier material at the opening be large enough to be slipped over the flange after donning the boots. In some embodiments, this additional material at the cuff opening is releasably constrained by elastic or other material that, when the cuff is in position around the boot flange, will constrict the cuff and keep it in constant contact with the flange surface. In this manner, vapors and/or liquids may be prevented from breaching the boot/trouser interface. The circumference of the elastic cuff may be expanded by, for example, greater than 2 cm, 5 cm or 10 cm. When elastic is used at the cuff opening it should provide enough tension to provide a continuous seal with the boot flange when used under expected conditions. It is preferred that the amount of tension should not be so great that the cuff cannot be manually removed from the flange, but because the cuff may be retained around a stiff flange, there is little concern of discomfort to the wearer from compression around the ankle Therefore, for reasons such as the stiffness afforded by a flange, greater elastic tension may be applied than might otherwise be used in traditional pieces of apparel.

Elastic material 234 may be hemmed into the cuff using conventional sewing techniques. Stitching, however, may be backed up with a non-permeable or selectively permeable tape to prevent leakage through the stitching. The elasticity is typically supplied by a polymer, a metal, a natural rubber, or a synthetic rubber. Different types of elastic include, for example, elastic tape, elastic cord and polymeric or metallic springs. In addition to placing an elastic band or cord in the cuff, there are other methods of forming a seal with the boot flange. Additional methods of temporarily securing the cuff to the boot flange include, for example, drawstring, hook and loop fasteners, flaps, snaps, clips, magnets, tape and pressure sensitive adhesive.

In another embodiment, the resistant barrier liner itself may be a resilient, stretchable fabric that exhibits enough tension itself to form a secure seal around the flange. Preferably, the fabric will stretch to an extent that allows the user to expand the circumference of the cuff opening by 2 cm or more. This may allow the wearer to pull the cuff over the boot flange and allow it to contract and seal against or below the shoulder of the flange. In this case, no additional elastic or closure may be required.

When a responder wearing trousers bends at the knee, for example when walking or climbing, the liner may be contracted in an upward direction and as a result applies an upward force to the cuff. In conventional trousers this movement is not a hindrance as the trouser cuff can freely slide up and down the boot. However, when a trouser liner is fixed to the boot, any resulting movement may either be restricted or may forcefully remove the cuff from the flange. In one set of embodiments, the trouser leg may be asymmetrical with the front portion of the leg longer than the rear portion. One, two or more layers of the trouser may be cut in this fashion. For example, the abrasion layer and/or the thermal layer and/or the resistant barrier layer may include a series of pleats and/or darts to add length in the area over the knee. For examples of this fitting technique, see co-owned U.S. Pat. No. 7,065,796, titled FIRE PROTECTIVE TROUSERS EXHIBITING REDUCED BINDING which is incorporated by reference herein.

Figure 6:
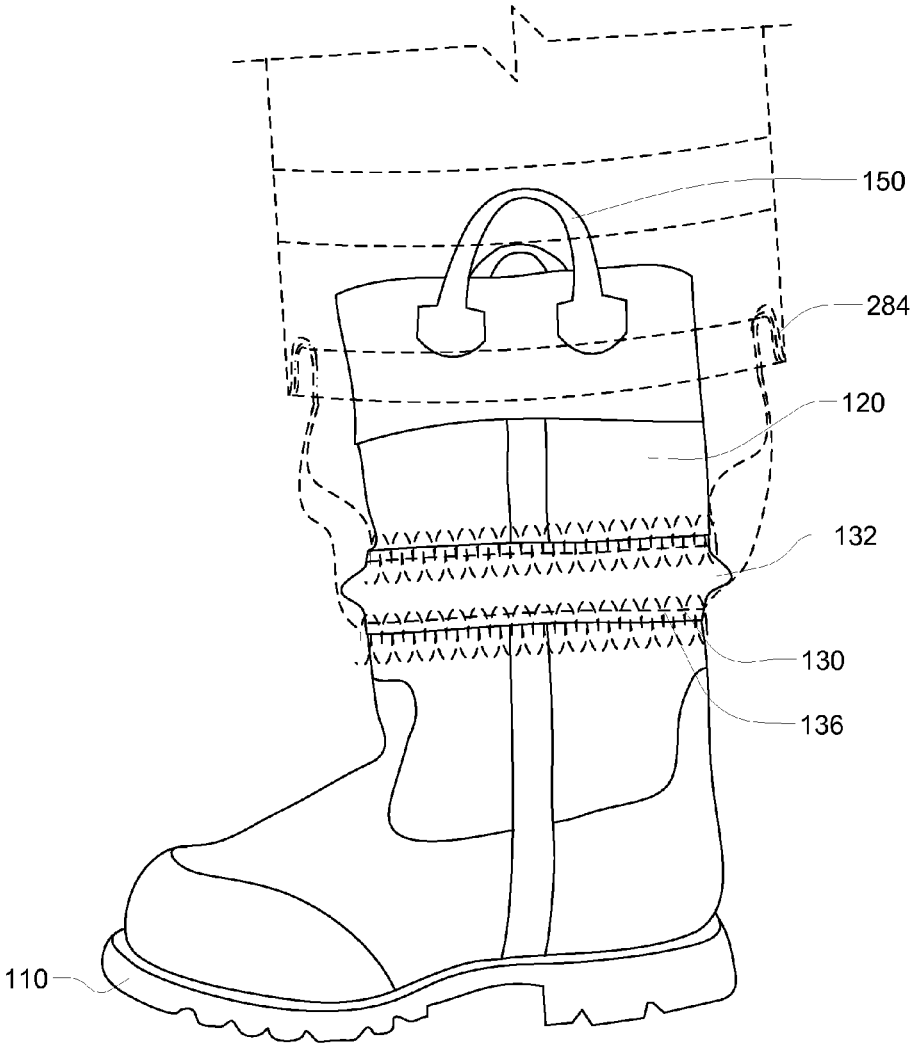
FIG. 6 provides a perspective view of another boot embodiment.
Figure 7:
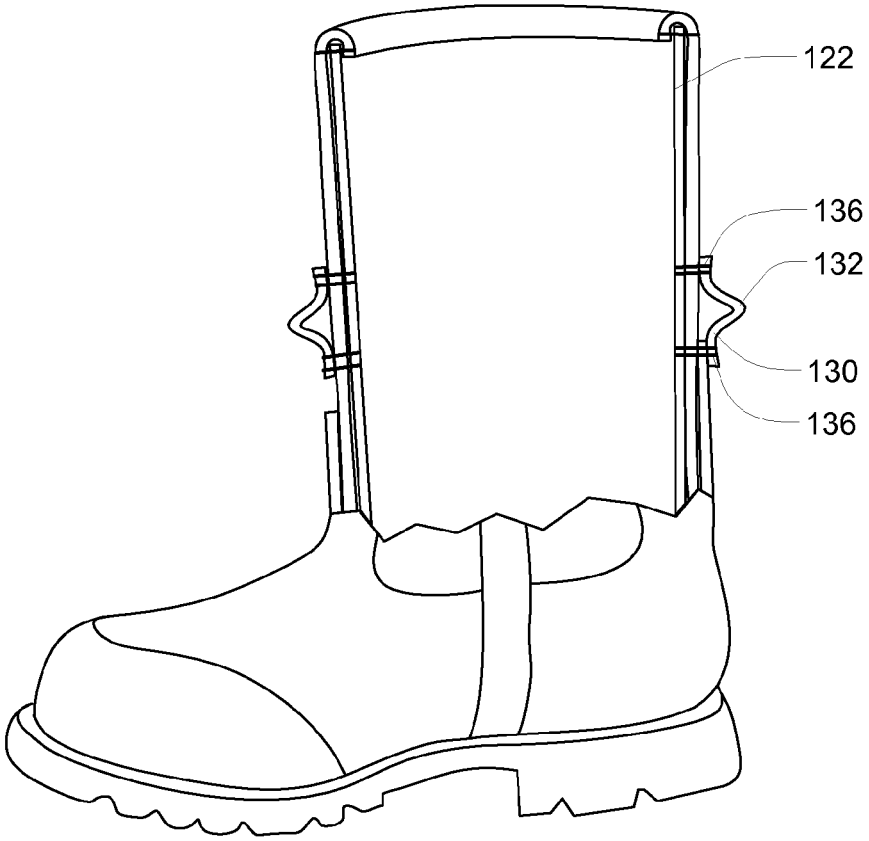
FIG. 7 provides a cut-away view of the embodiment shown in FIG. 6.
Figure 9:
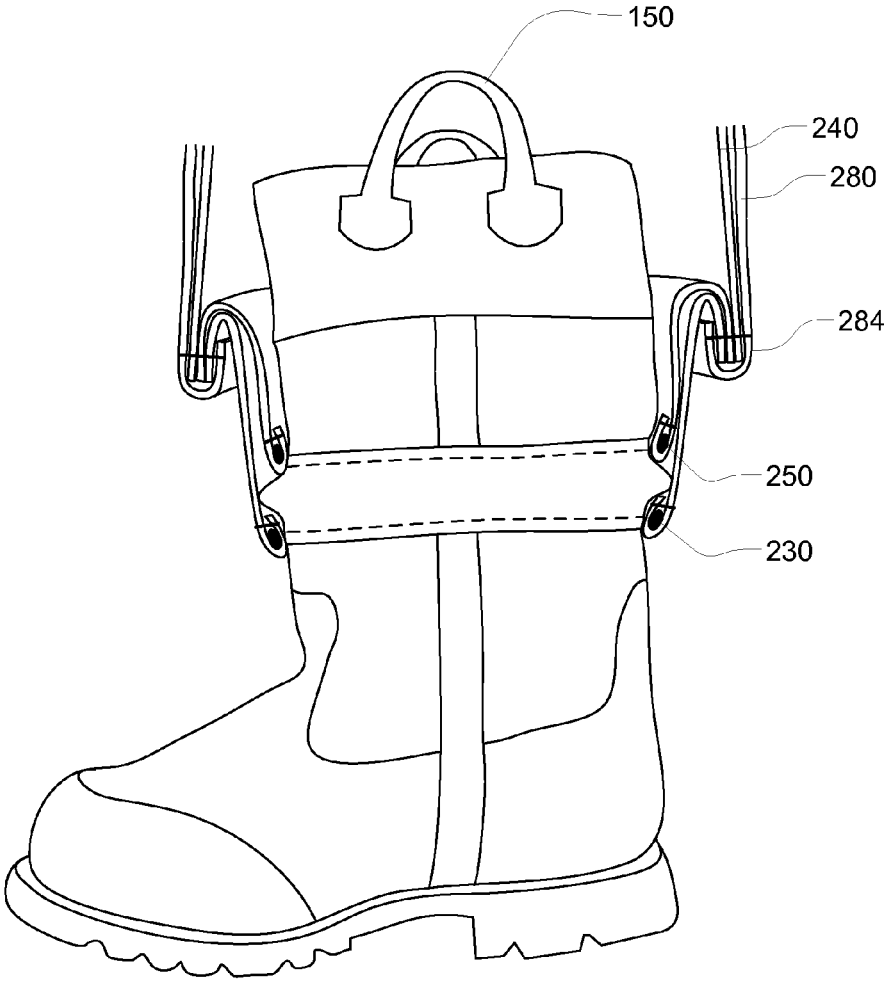
FIG. 9 provides a view of the embodiment shown in FIG. 6 with a cut-away view of associated trousers with resistant barrier cuffs.
Figure 10A:
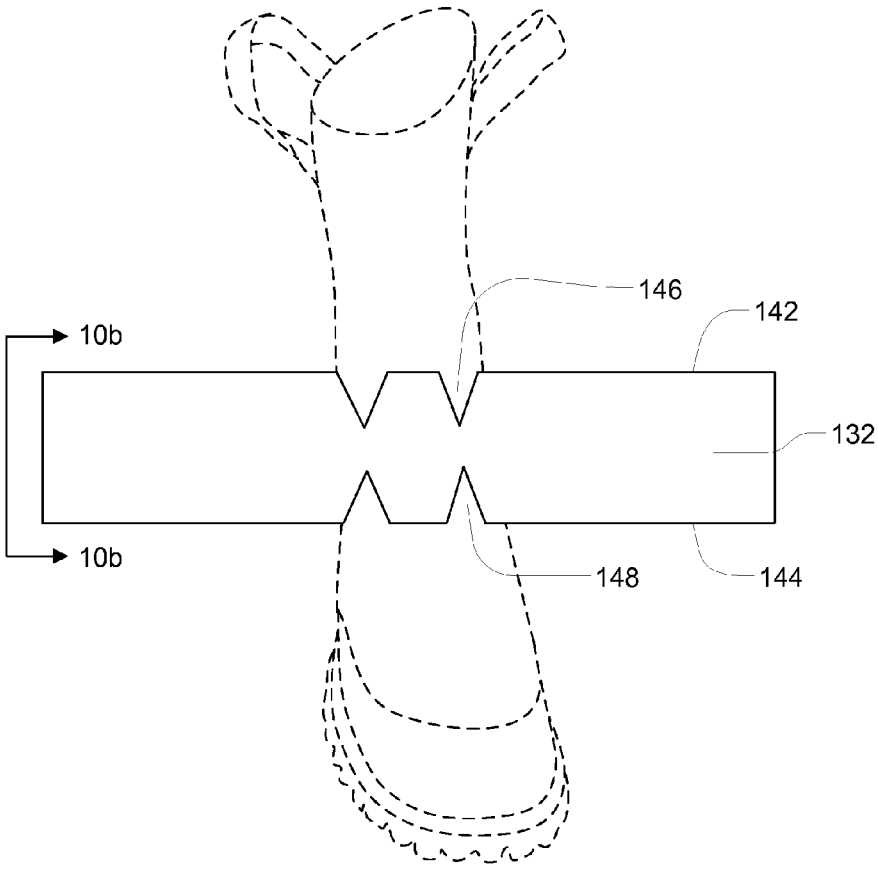
FIG. 10*a* provides a plan view of a strip of material prior to being formed into a flange.
Figure 10B:
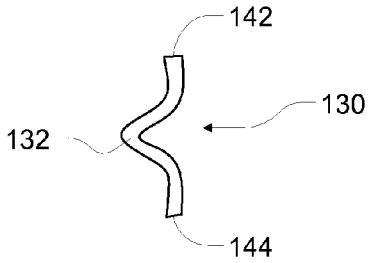
FIG. 10*b* provides an end view of the flange of FIG. 10*a* after it has been formed.

In another set of embodiments this effect may be reduced or prevented by forming and shaping the liner, including the cuff(s), to be longer than the exterior layers of the trousers. This extra length is shown in, for example, FIGS. 4, 9, 14 and 15. When the wearer is in a standing position, the liner may not be fully extended, resulting in some slack in the liner. See FIG. 5. This liner slack is typically hidden behind the outer layer of the trousers and the flexible liner may simply bunch up or fold out of the way underneath the outer layer. When the leg is bent, the bunched or folded portion is extended, allowing leg movement to proceed without placing significant upward force on the liner cuff. At the same time, the exterior layer of the trousers may be pulled to a higher position, thus revealing the liner underneath but without compromising the seal between the liner cuff and the boot flange. FIGS. 6 and 9 provide illustrations where outer layer cuff 284 is pulled up (bent knee position, for example) above the level of flange 130 and where primary liner cuff 230 is extended to provide freedom of movement while retaining a vapor/liquid seal with flange 130. Of course the outer trouser layer may also be cut longer to hide the liner whether or not the knee is in a bent or straight position. In some embodiments the liner may be affixed to the outer layer and the two layers may move together. In other embodiments, the liner may be affixed to an outer layer down to the level of the outer layer cuff, but then the liner may extend independently below that level. The length of the resistant barrier liner is preferably great enough to allow for complete flexion of the knee without pulling the cuff off of the flange and without providing undue restriction of movement to the wearer. In some embodiments, the liner cuff may extend to greater than or equal to 2, 5, 10 or 15 cm below outer layer cuff 284.

An optional second cuff 250 may also be formed from the resistant barrier liner. The cuff may be of the same or different material than primary cuff 230 and may be of similar design. Second cuff 250 may be of slightly smaller circumference than primary cuff 230 because it typically forms a vapor/liquid seal directly with the outer surface of the upper of the boot, above the flange. Secondary cuff 250 can supply an additional defense against breach of the trouser/boot interface. Should the first cuff leak for any reason, an optional second cuff may help to maintain the integrity of the ensemble.

In another aspect of the invention, a trouser is provided that includes a resistant barrier liner having a gusset portion to protect the mid-section of the responder.

The front portion of conventional firefighter's trousers include a fly typically closeable by a zipper or snaps and partially sealed by overlapping flaps of outer material. This design is often adequate for keeping the firefighter dry under most firefighting conditions. The fly also facilitates the donning and removal of the trousers, but it may not provide adequate protection against intrusion of hazardous vapors and/or liquids. Thus, to protect a responder under conditions that may include chemical agents and biological pathogens, a different design is desired.

Figure 11:
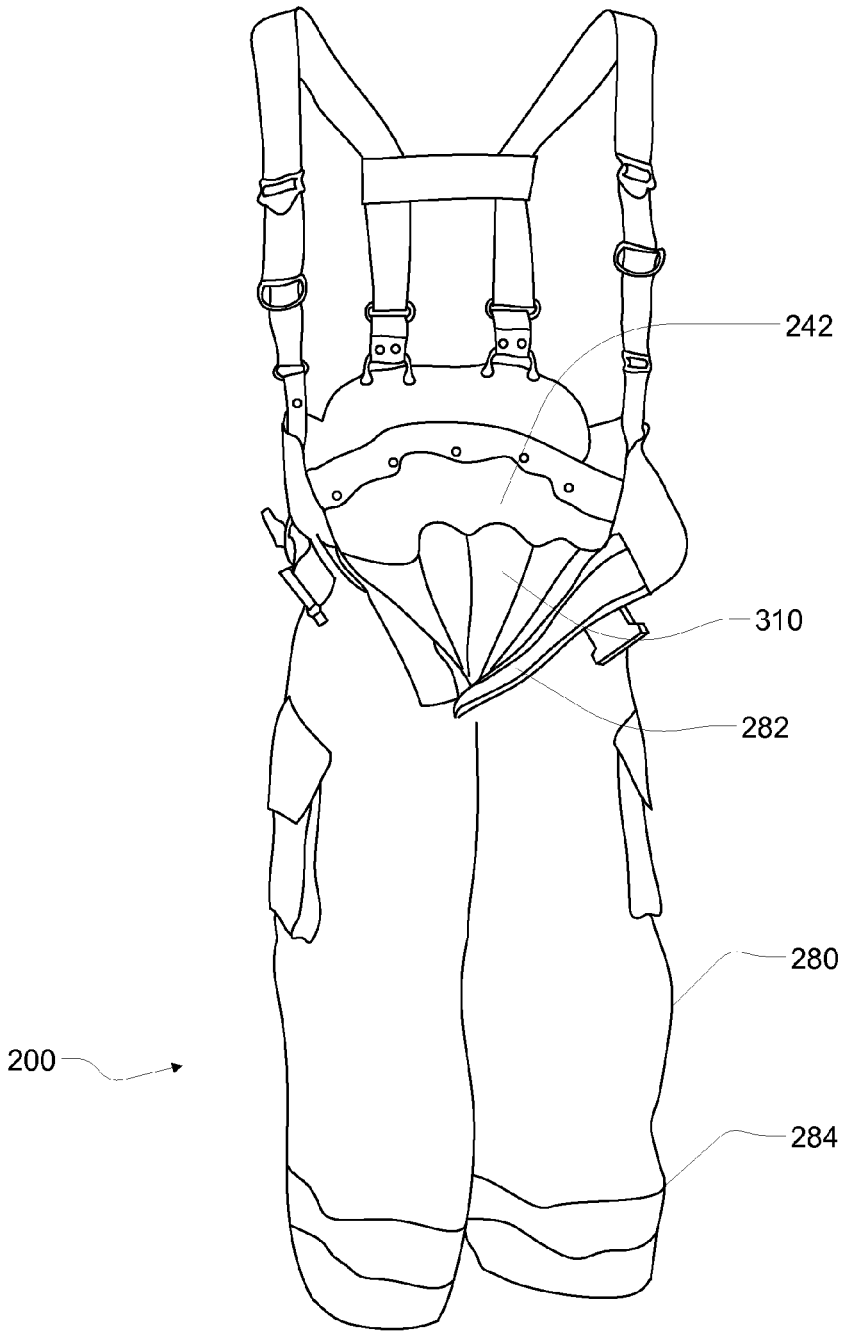
FIG. 11 provides a perspective view of an embodiment of a pair of trousers including a gusset liner.
Figure 12:
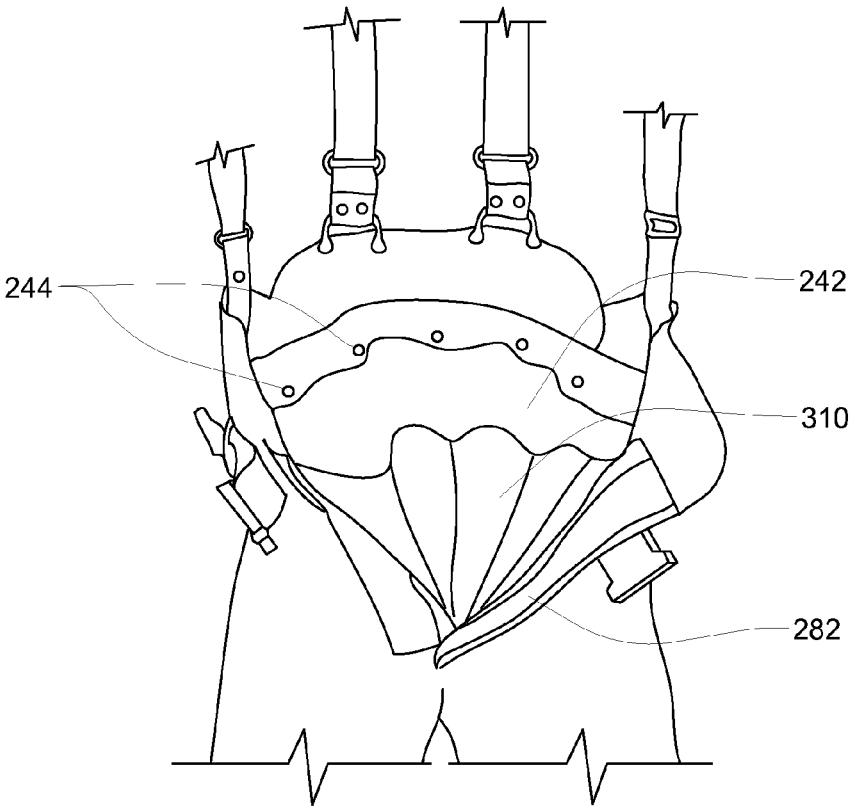
FIG. 12 provides a close up view of the gusset liner of FIG. 11.
Figure 13A:
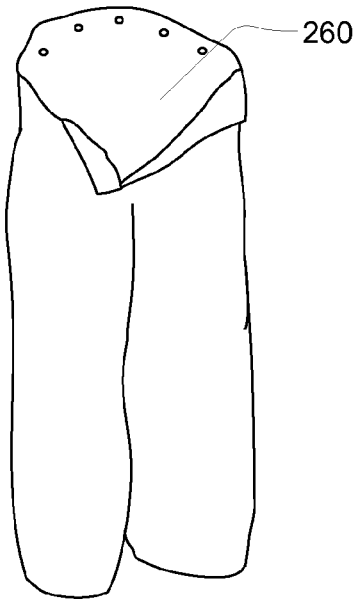
FIG. 13*a* provides a view of a thermal liner removed from the trousers of FIG. 11.
Figure 13B:
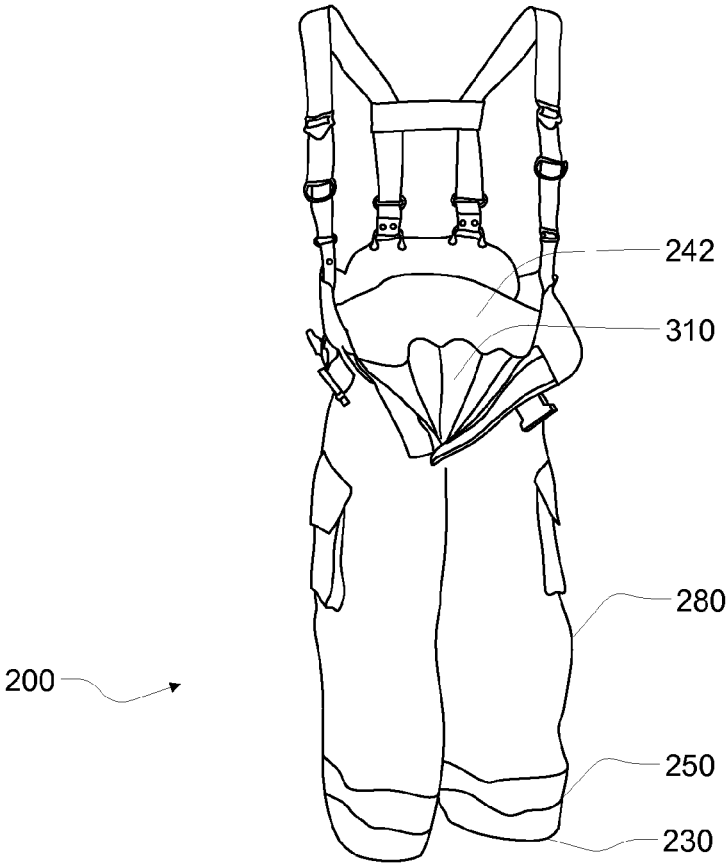
FIG. 13*b* provides a view of the liner of FIG. 13*a* inserted to a pair of trousers.

FIGS. 11 and 12 illustrate a resistant barrier liner for trousers that includes an upper portion 242 comprising gusset 310 in a front section of the liner. Gusset portion 310 may be positioned behind the fly portion of other trouser layers, e.g., abrasion resistant and/or thermal layers. Gusset portion 310 provides enough lateral expansion of the liner to allow for easy donning and removal of the trousers. However, when made of a liquid or vapor resistant material it provides a barrier against liquid and/or vapor intrusion that may occur with a fly or other design. This design can provide a continuous barrier from the ankle cuff up to the waist. The portion of the barrier liner that forms gusset 310 may be folded, for example, accordion style, when the trousers are buckled up. When the trousers are unbuckled and fly 282 opened up, gusset 310 expands to promote unimpeded donning or removal of the garment. The gusset may add greater than 3, greater than 5, or greater than 10 inches to the circumference at waist level when the gusset is fully expanded. Preferably, the gusset comprises materials that provide enough stiffness and body so that the top edge of gusset 310 does not sag below waist level during routine use. In another embodiment, temporary fasteners, such as hook and loop fasteners, may be used to keep adjacent folds together, thus preventing the liner from sagging. Temporary fasteners such as snaps may also be used to affix the gusset (and other portions of the liner) to other layers of the trousers. This can serve to keep the liner in position but still provides for easy removal of the trouser system. Thermal layer 260 (FIG. 13A) may also be included and may be placed inside the resistant barrier liner. Alternatively, the thermal layer may be placed between an outer layer and the resistant barrier layer. The thermal layer may also be fixed to the trousers using fasteners such as snaps 244.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined. Other elements may optionally be present other than the elements specifically identified by the "and/or" clause, whether related or unrelated to those elements specifically identified unless clearly indicated to the contrary.

All references, patents and patent applications and publications that are cited or referred to in this application are incorporated in their entirety herein by reference.

What is claimed is:

1. A protective boot for use with resistant barrier trousers, the boot comprising:

an upper with a top portion, a middle portion, and a bottom portion, the upper having an interior surface and an exterior surface;

a protective barrier liner within the exterior surface;

a sole affixed to the bottom portion of the upper; and a flange circumscribing and affixed to the exterior surface of the middle portion of the upper at a fixed distance above the sole wherein the flange is of greater stiffness than that of the upper, the flange including a shoulder producing a downward facing cavity constructed and arranged to retain a resistant barrier liner cuff of the resistant barrier trousers when worn with the protective boot, wherein the middle portion of the upper extends upwardly from the flange and the top portion extends upwardly from the middle portion.

2. The protective boot of claim 1 wherein the flange comprises an extruded material.

3. The protective boot of claim 1 wherein an outer circumference of the flange is at least about 5% greater than the outer circumference of the upper at the point where the flange is attached to the upper.

4. The protective boot of claim 1 wherein the flange is comprised of an elastomer.

5. The protective boot of claim 4 wherein the elastomer is selected from the group consisting of acrylics, polyacrylates, butyl, polybutene and polyisobutylene polymers; ethylene copolymers, fluoropolymers, silicone, polyurethane, polyether block amide (PEBA), styrene butadiene rubber (SBR), vinyl and polyvinyl chloride (PVC).

6. The protective boot of claim 1 wherein the flange and the resistant barrier liner cuff provide a continuous protective barrier with the resistant barrier trousers and the protective barrier linear of the protective boot.

7. The protective boot of claim 6 wherein the flange includes an inner wall surface wherein the inner wall surface is oriented at an angle of less than about 90 degrees with respect to the upper to which the flange is attached.

8. The protective boot of claim 6 wherein the flange comprises an extruded polymer.

9. The protective boot of claim 6 wherein the flange is attached to the upper at a point above the cavity.

10. The protective boot of claim 9 wherein the flange is stitched to the upper at a point above the cavity.

11. The protective boot of claim 6 wherein the flange comprises a fire resistant material.

12. The protective boot of claim 6 comprising a resistant barrier liner.

13. The protective boot of claim 6 wherein the flange is comprised of flame resistant PVC.

14. A method of manufacturing a protective boot comprising:

attaching a bottom portion of an upper to a sole;

providing a protective barrier liner within the protective boot;

circumscribing a middle portion of the upper with a flange, wherein the middle portion of the upper extends upwardly from the flange and the flange is affixed to an exterior surface of the middle portion of the upper at a fixed distance above the sole wherein the flange is of a greater stiffness than that of the upper; and securing the flange to the upper to produce a boot capable of interfacing with a cuff of a resistant barrier liner in a pair of trousers.

15. The method of claim 14 further comprising forming a downward facing cavity between the flange and the boot upper.

16. The method of claim 14 further comprising integrating a resistant barrier layer into the upper.

* * * * *

UNITED STATES PATENT AND TRADEMARK OFFICE

CERTIFICATE OF CORRECTION

PATENT NO. : 7,908,767 B1
APPLICATION NO. : 11/615242
DATED : March 22, 2011
INVENTOR(S) : Mark Mordecai et al.

It is certified that error appears in the above-identified patent and that said Letters Patent is hereby corrected as shown below:

On the title page, item [73]; should read

Assignee: ~~Hi-Tec Sports USA, Modesto, CA (US)~~

Assignee: Globe Holding Company LLC, Pittsfield, NH 03263 (US)

Assignee: North Carolina State University, Raleigh, North Carolina 27606 (US)

Signed and Sealed this
Twenty-first Day of January, 2014

Michelle K. Lee

Michelle K. Lee
*Deputy Director of the United States Patent and Trademark Office*